US009782867B2

(12) United States Patent
Hintz

(10) Patent No.: US 9,782,867 B2
(45) Date of Patent: Oct. 10, 2017

(54) WATER JET REAMING TOOL

(71) Applicant: Gordon Leo Hintz, Lompoc, CA (US)

(72) Inventor: Gordon Leo Hintz, Lompoc, CA (US)

( * ) Notice: Subject to any disclaimer, the term of this patent is extended or adjusted under 35 U.S.C. 154(b) by 3 days.

(21) Appl. No.: 14/941,641

(22) Filed: Nov. 15, 2015

(65) Prior Publication Data

US 2017/0136598 A1 May 18, 2017

(51) Int. Cl.

| | |
|---|---|
| ***B24B 23/02*** | (2006.01) |
| ***A47L 11/10*** | (2006.01) |
| ***A47K 11/10*** | (2006.01) |

(52) U.S. Cl.
CPC ..... *B24B 23/024* (2013.01); *A47K 11/10* (2013.01)

(58) Field of Classification Search
CPC ..... B24B 23/024; A47K 11/00
See application file for complete search history.

(56) References Cited

U.S. PATENT DOCUMENTS 4,846,599 A * 7/1989 Seddon ..... A47K 11/10 15/210.1
5,440,775 A * 8/1995 Banks ..... A47K 11/10 15/106
5,971,141 A 10/1999 Shafik
5,984,555 A * 11/1999 Samad ..... A46B 9/02 15/164
6,922,865 B1 * 8/2005 Logan, Sr. ..... A47K 11/10 15/114
8,011,051 B1 * 9/2011 Ba-Akeel ..... A46B 5/0012 15/21.1
2005/0108844 A1 * 5/2005 Grobbel ..... A47K 11/10 15/210.1

OTHER PUBLICATIONS

InterNet: FAMILYHANDYMAN.COM How to Clean a Sluggish Toilet.

* cited by examiner

*Primary Examiner* — Dung Van Nguyen
(74) *Attorney, Agent, or Firm* — Felix L. Fischer

(57) ABSTRACT

The water jet reaming tool can avoid the need to replace a toilet (17). The curved handle (19) allows the user to stay at arm's length away from the difficult removal of mineral deposits (13) which prevent sufficient clean water (14) to flush the toilet. A reamer element (12) stands ready at the other end of the handle (19) to enter a clean water jet (15) under the toilet inner rim (16). The user views (11) the water jet (15) and the point 26 via lines of sight (18) from the reflection in the metal mirror (30) attached to the reamer element (12). The user's wrist motions cause the handle (19) to rotate the reamer element (12) and grind the mineral deposits (13) to dust.

1 Claim, 4 Drawing Sheets

WATER JET REAMING TOOL

BACKGROUND

Prior Art

The following is a tabulation of some prior art that appears relevant to toilet water jets:

| U.S. Pat. No. | Issue Date | Patentee |
|---|---|---|
| 5,971,141 | Oct. 26, 1999 | Aasef M. Shafik |

Water jets in the present context are under the inner rim of a toilet bowl. They provide the water which makes flushing successful. When these jets are restricted because of mineral deposits, flushing cannot reach the siphon stage.

The U.S. Pat. No. 5,971,141 describes a Water Jet Pick as part of a Toilet Accessory Kit. Within its Prior Art heading, a paragraph begins; "None of the patents noted above discloses a tool for cleaning the jets in a toilet bowl". With this statement plus the Water Jet Pick disclosure, none of these patents mentioned describe a "Water Jet Reaming Tool" as described in the present patent application. The present tool is rotational in nature with aggressive edges for grinding.

In non-patent literature, descriptions of the water jet problem exist. None mention a tool except to improvise, by bending a wire coat hanger and use a hand held mirror. Other statements exist which suggest simply replacing the toilet.

SUMMARY OF EMBODIMENTS

The first embodiment is constructed from individual parts. It is a reaming tool with raised edges rotating clockwise then counterclockwise to enter a water jet and grind mineral deposits to dust. The reamer element of the first embodiment has a square shaft to engage the handle for maximum torque transmission. The handle is a semicircular curve with a mirror cantilevered from the reamer element.

The second embodiment is made from one piece of metal and therefore has no torque transmission concerns. The pointed reamer is at the end of a metal rod which is then bent to become a handle. Simplicity is the purpose of the second embodiment.

DRAWINGS

Some components labeled by name may also be labeled by its raw material name.

First Embodiment

Figure 1:
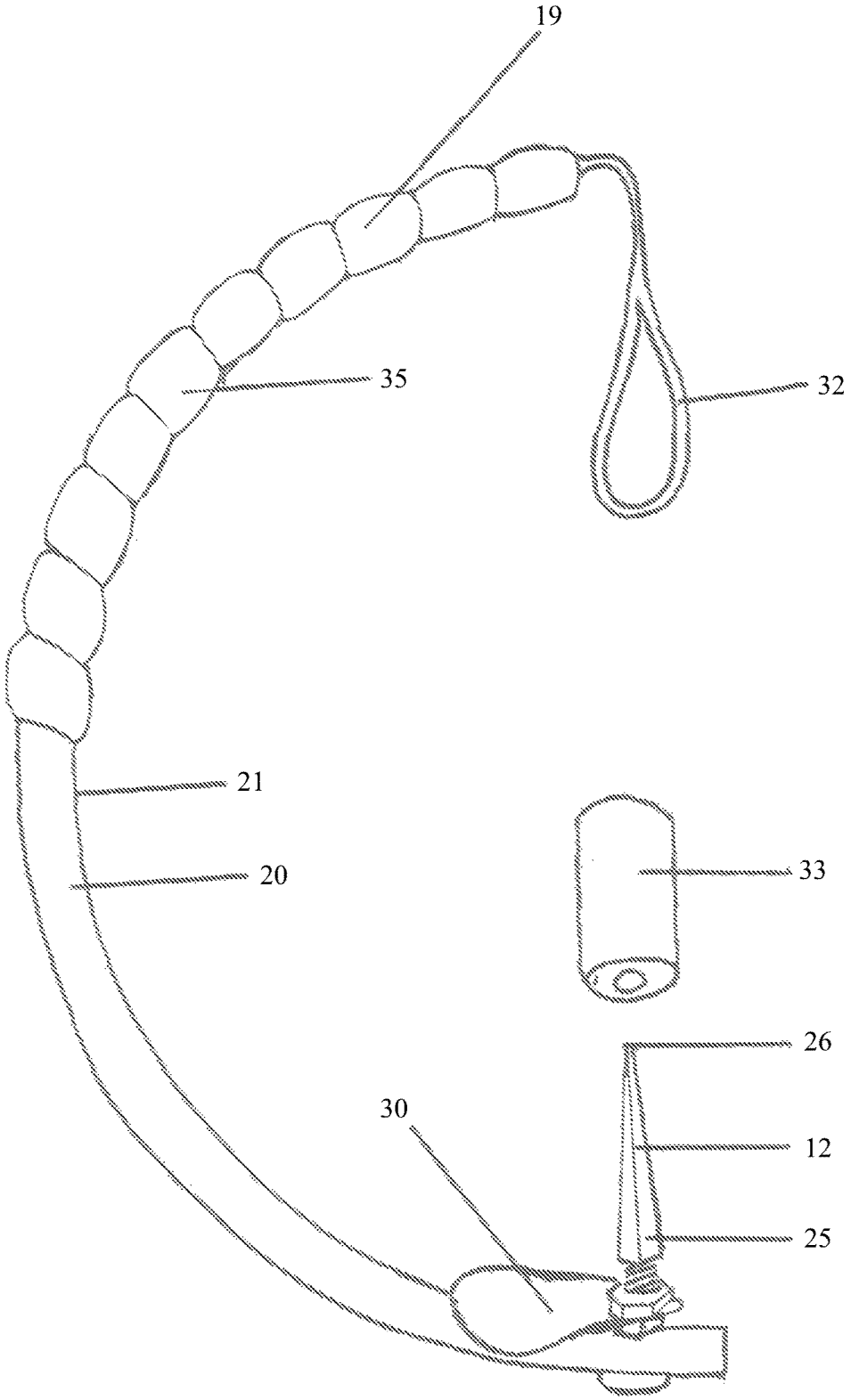
Figure 2:
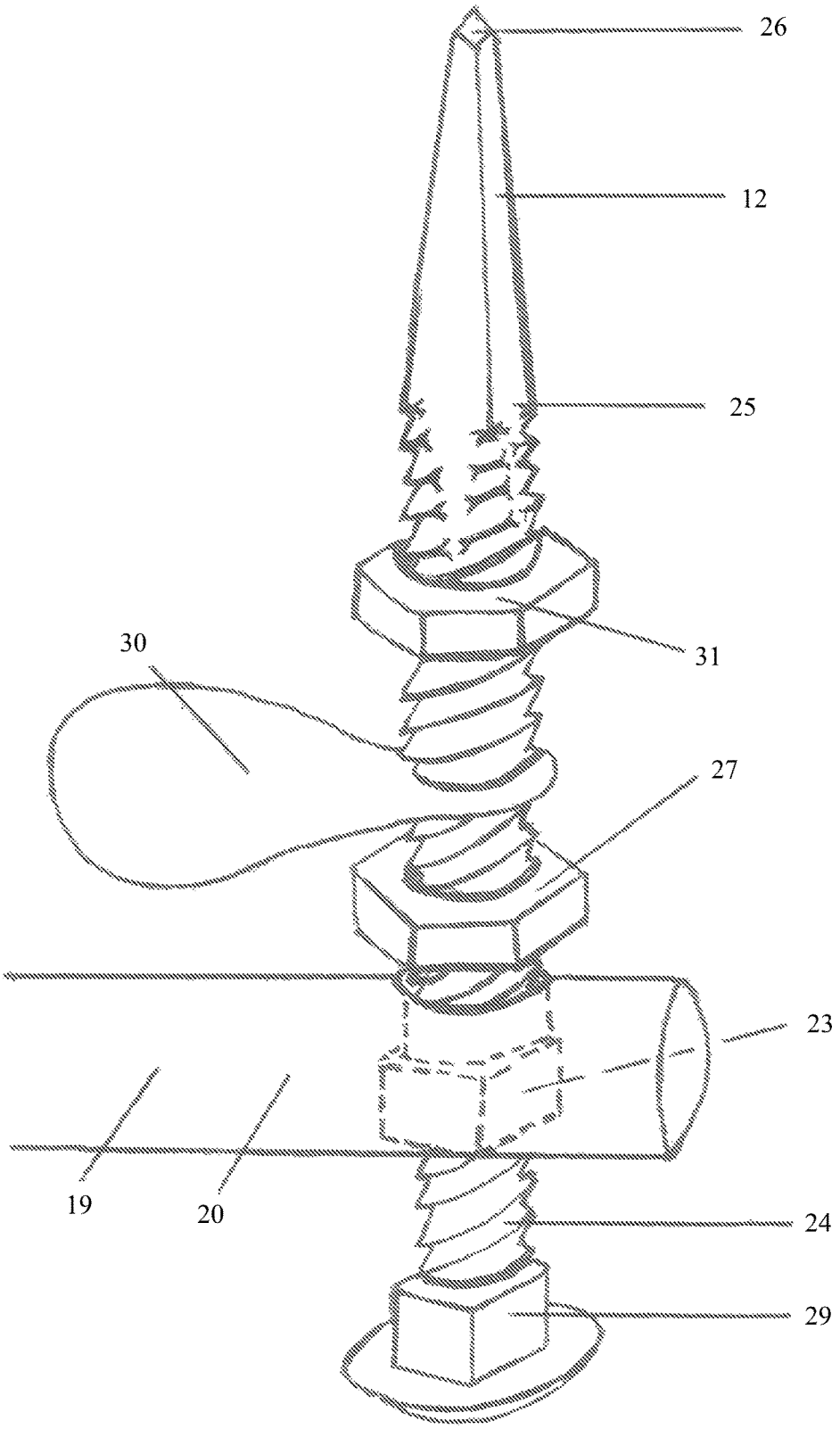
Figure 3:
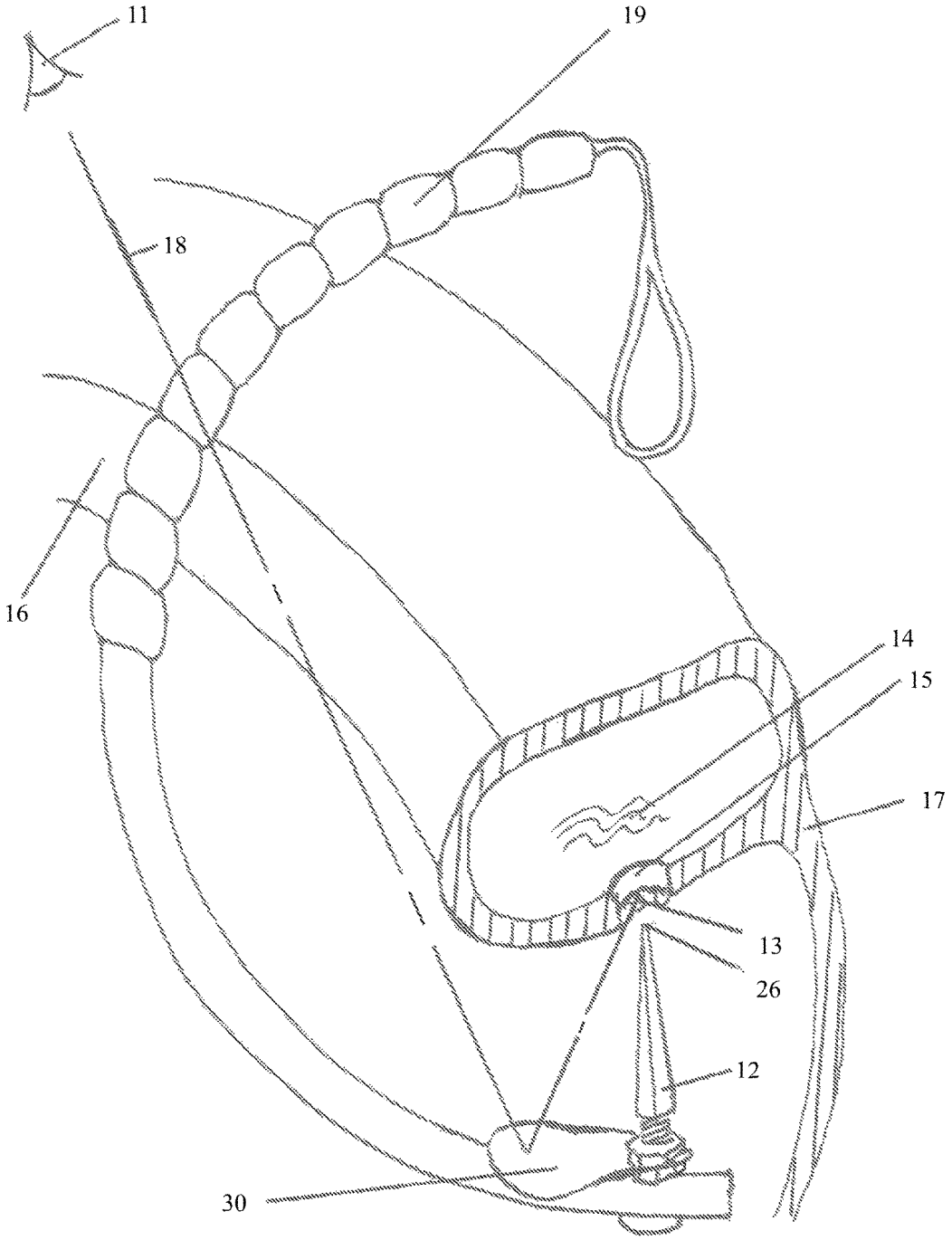

FIG. 1, Water Jet Reaming Tool
FIG. 2, Reamer Element Attachment
FIG. 3, Abstract View

Second Embodiment

Figure 4:
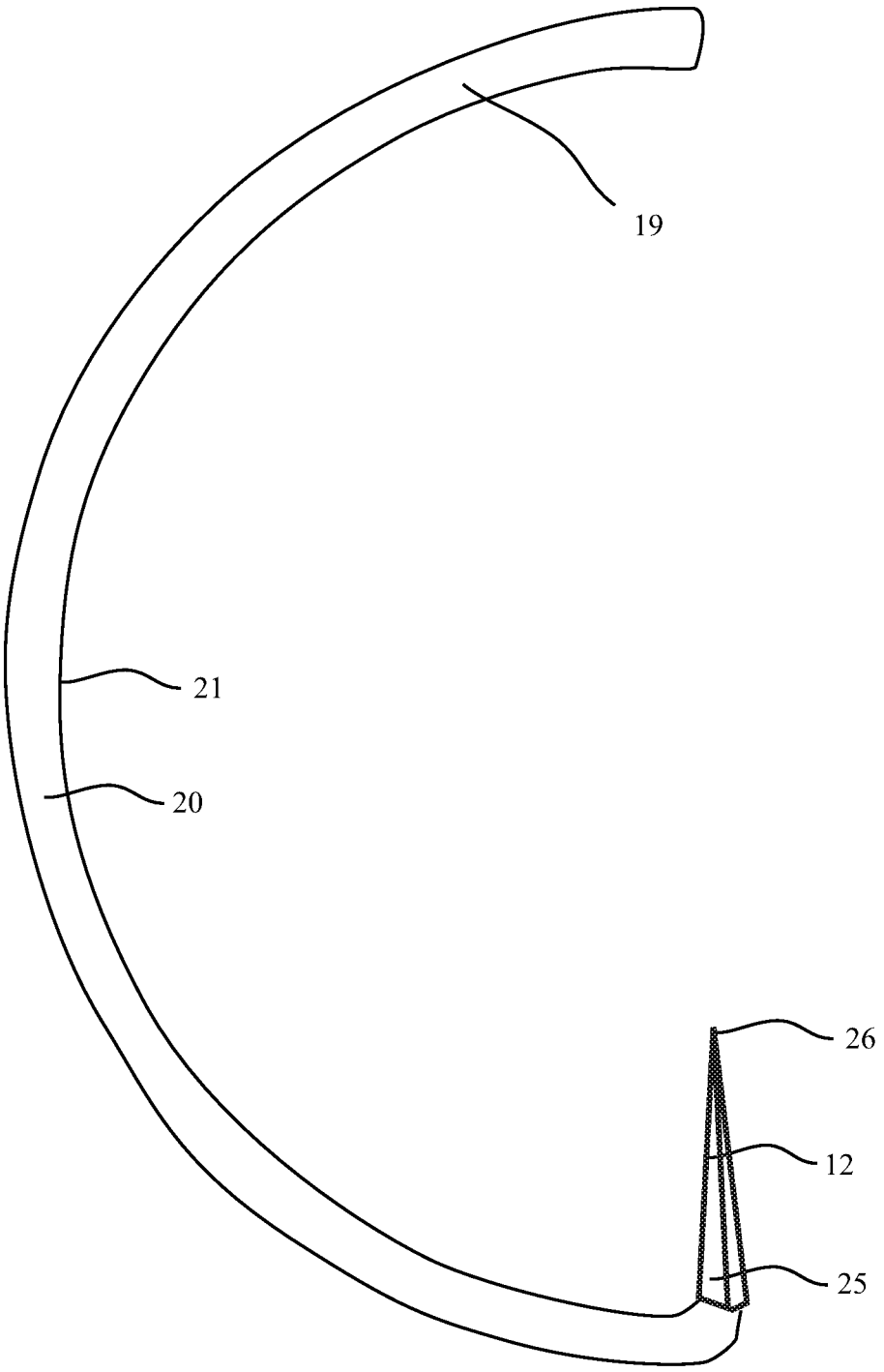

FIG. 4, Water Jet Reaming Tool (one piece)

DRAWINGS—REFERENCE NUMBERS

11. User's Eye
12. Reamer Element
13. Mineral Deposits

14. Clean Water
15. Water Jet
16. Toilet Inner Rim
17. Toilet Cross Section
18. Lines of Sight
19. Handle
20. Metal Rod
21. Semicircle
22. (not used)
23. Square Hole
24. Carriage Bolt
25. Tall Narrow Pyramid
26. Point
27. First Threaded Nut
29. Square Shaft
30. Metal Mirror
31. Second Threaded Nut
32. Lanyard of Flexible Material
33. Safety Guard
35. Coating

DETAILED DESCRIPTION—FIRST EMBODIMENT—FIGS. 1,2, and 3

In FIG. 1, the Water Jet Reaming Tool is shown with a short length of rubber hose to push down to cover the point 26 of the reamer element 12 as a safety guard 33 for storage purposes. The handle 19 is made from a metal rod 20 one half inch (1.27 cm) diameter and twenty inches (50.0 cm) long. When it is bent into a semicircle 21 the handle 19 shape is defined. Cover the surface of the upper half of the handle 19 with a rubber coating 35. This coating could be a piece of rubber hose, a wrapping, or a plastic dipping. Attach a lanyard of flexible material 32 to the end of the handle 19.

The reamer element 12 in FIG. 2, is a two inch (5.0 cm) long carriage bolt 24 sharpened by grinding the threads forming a tall narrow pyramid 25. The pyramid may have three or more cutting edges. A strong attachment between the reamer element 12 and the handle 19 is necessary to transfer sufficient torque to rotate the one quarter inch (0.63 cm) diameter reamer element 12 while grinding. One half inch (1.27 cm) from the lower end of the handle 19, a one quarter inch (0.63 cm) diameter square hole 23 is made directed toward the handle's 19 center of curvature. Since the carriage bolt 24 has a square shaft 29 it fits into the square hole 23. One can replace the metal rod 20 by a metal pipe of the same size for a handle, and it would only require the square hole into one wall of the pipe. Now assemble the tall narrow pyramid 25 into the square hole 23 with its point 26 directed toward the handle's 19 center of curvature. A first threaded nut 27 slipped over the tall narrow pyramid 25 engages a few screw threads and when tightened assures the torque transfer squares are in place. A metal mirror 30 is attached to the reamer element 12. The metal mirror 30 has an appendage with the bolt size hole that fits over the reamer element 12 and is tightened with the second threaded nut 31. The metal mirror can be adjusted by bending the mirror.

In FIG. 3, a toilet cross section 17, shows the Water Jet Reaming Tool poised to grind mineral deposits 13. The hand powered rotational reamer element 12 is used to remove mineral deposits 13 restricting the clean water 14 leaving a water jet 15 in the toilet inner rim 16. Lack of sufficient water volume causes the toilet to fail reaching the siphon stage of flushing. This hand tool allows the user to see, reach and open the clean water 14 source hidden under the toilet inner rim 16, while working with hands outside of the toilet. The mineral deposits 13 are removed when the reamer element 12 is pulled up by handle 19 and into the water jet 15 and rotated clockwise and counter clockwise and grinding continues. The metal mirror 30 provides line of sight 18 to the user's eye 11. This allows the user to see what the point 26 is touching, not merely seeing the underside of the toilet rim 16.

OPERATION OF FIRST EMBODIMENT

This tool will rejuvenate a toilet which has become the victim of built up mineral deposits from the water used in the past to flush it. Each time water dried up in a water jet, a tiny mineral deposit occurred. This problem results in a weak attempt to flush and seemingly useless water motion in the toilet bowl without a final outcome. Before starting, measure the time it takes for the tank to empty after starting the flush. Also make a mental note of the pattern of the water flowing into the bowl coming from the water jets, to know which jets to work on.

Begin using this tool with no water running. Lower the mirror end of the handle under the toilet inner rim. When the point of the reamer element is under the toilet inner rim, look into the metal mirror. The mirror is adjusted correctly when you can see the point of the reamer element. Concentrate on the rest of the image in the mirror. A water jet will be seen after a small movement from the initial position. Direct the reamer element into it. Then pull upward slightly and begin a wrist motion which causes the handle to swing. You will notice the tool begins to disappear under the shelf of the toilet inner rim. The grinding of the reamer element removes some mineral deposit making room for the tool to disappear. Many toilets have water jets which attempt to cause the water in the bowl to rotate counterclockwise. Attempt to feel if one or more water jets offer less resistance to the tool when you tilt the tool. Then use this same tilt on all water jets completely around the bowl. Attempt to achieve the same reaming depth on all water jets. You are deep enough when the effort becomes greater. When you are finished, the water flow will be greater and the tank of water will empty faster. It's a measure of victory to now measure the new time and see improvement and hear the sound of a siphon assisted flush.

Advantages

This tool is easy to work. The results show the efficiency of grinding. Toilets restored with this tool demonstrate considerable water tank emptying improvement and flush action in the bowl. The reamer element is easy to replace when worn.

DETAILED DESCRIPTION—SECOND EMBODIMENT—FIG. 4

In FIG. 4, a reamer element 12 with attached handle 19 is made from one piece of metal. A metal rod 20 one quarter inch (0.63 cm) diameter and twenty two inches (56 cm) long was made narrower toward one end. A tall narrow pyramid 25 was formed from approximately two inches (5 cm) length of the material on that end of the metal rod 20. The pyramid 25 may have three or more cutting edges. The other part of this metal rod 20 is bent uniformly along its twenty inches (50 cm) of length into a semicircle 21 such that its plane contains the tall narrow pyramid 25. Since the tall narrow pyramid 25 is tangent to the semicircle 21 it must now be bent ninety degrees to point toward the semicircle's center of curvature. The semicircle 21 portion of this metal rod 20 serves as the handle 19 for the reamer element 12.

OPERATION OF THE SECOND EMBODIMENT

This simpler tool will accomplish the same task as the first embodiment, but the user is required to develop more skill for this simpler tool. Once reaming of a given water jet begins, both tools operate the same; pulling upward with rotational grinding removes the mineral deposits. The increased user skill involves locating the toilet water jets, without the metal mirror. A water jet is be found by gently rubbing the point of the reamer element on the underside of the toilet inner rim.

Advantages

The chief advantage of the second embodiment is its ease of manufacture. Bending and shaping can be done with fewer machines. There are no parts to unite, assembly details are gone.

CONCLUSION

This tool in either embodiment can avoid the need to replace a toilet.

I claim:

1. The first embodiment provides a reamer element to rotate and grind mineral deposits restricting water leaving a water jet in a toilet inner rim and a metal mirror cantilevered from said reamer element providing lines of sight to the user's eye to find said water jet comprising:

a. a carriage bolt which has a square shaft is modified by grinding its threads a predetermined distance to the point of said carriage bolt to form a tall narrow pyramid having a predetermined number of edges becomes the reamer element, b. a metal rod or pipe of predetermined size and length when bent to become semicircle forms a handle for the reamer element, c. place the reamer element pointing toward said handle's center of curvature through a square hole in the handle a predetermined distance from one end of the handle and use a first threaded nut to firmly attach the reamer element to the handle and said square hole in the handle engages with said square shaft of the carriage bolt to provide torque transmission from the handle to the reamer element, d. said metal mirror having a hole drilled in it the diameter of the carriage bolt is placed onto the reamer element down to the remaining threads and followed by a second threaded nut and tightened to hold the metal mirror securely and said first threaded nut provides a space beneath the metal mirror for adjustment bending of the metal mirror.

* * * * *